US006205659B1

(12) United States Patent
Iwata

(10) Patent No.: US 6,205,659 B1
(45) **Date of Patent: *Mar. 27, 2001**

(54) METHOD FOR FORMING PUSH ROD FOR SWITCH

(75) Inventor: Keiji Iwata, Saitama (JP)

(73) Assignee: Toyodenso Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/109,083

(22) Filed: Jul. 2, 1998

(30) Foreign Application Priority Data

Jul. 4, 1997 (JP) ..... 9-180158

(51) Int. Cl.[7] ..... H01R 43/00

(52) U.S. Cl. ..... 29/883; 29/874; 29/885; 264/259; 264/328.5; 264/550

(58) Field of Search ..... 29/874, 882, 884, 29/885, 883; 264/259, 328.4, 328.5, 510, 511, 550, 266

(56) References Cited

U.S. PATENT DOCUMENTS 4,006,526 * 2/1977 Vidalin ..... 29/622
4,633,579 * 1/1987 Strasser ..... 29/622
5,277,567 * 1/1994 Bauer et al.. ..... 425/130
5,491,884 * 2/1996 Potts et al. ..... 29/622
5,707,581 * 1/1998 Yamazaki ..... 264/511
5,759,477 * 6/1998 Yamamoto ..... 264/513
5,783,132 * 7/1998 Matsumoto et al. ..... 264/257
5,800,771 * 9/1998 Ohno ..... 264/510
5,870,817 * 2/1999 Sehlhorst et al. ..... 29/622
5,897,823 * 4/1999 Davis et al. ..... 264/266

* cited by examiner

*Primary Examiner*—Lee Young
*Assistant Examiner*—Kevin G. Vereene
(74) *Attorney, Agent, or Firm*—Birch, Stewart, Kolasch & Birch, LLP

(57) ABSTRACT

A band-like raw material which becomes a contact plate is supplied to a position between an upper mold and a lower mold as these molds are closed, a convex part for the contact with the lower mold is engaged with a concave part for contact with the upper mold, by which, simultaneously punching out the contact part onto a part of the band-like raw material, the band-like raw material is cut to a predetermined length between edge parts to form the contact plate. At this time, a tip of a press pin on which the concave part is formed is brought into direct contact with a central part of the band-like raw material. A resin is injected into the mold cavities to form a push rod integrally with the contact plate, and the central part of the contact plate is deformed in the concave part to provide a stopgap.

7 Claims, 4 Drawing Sheets

METHOD FOR FORMING PUSH ROD FOR SWITCH

BACKGROUND OF THE INVENTION

1. Field of the Invention

The present invention relates to a forming method for a push rod to be used for a push switch or the like.

2. Description of the Prior Art

A conventional push switch is made such that by pressing an end of a push rod a movable contact provided at another end of the push rod is brought into contact with a fixed contact provided inside the switch body in order to effect the switch ON/OFF position. A general manufacturing method for such a push rod is to cut a band-like contact plate material into a predetermined size and form a contact part by punching out. The contact plate is put into a forming mold to close the mold, followed by injecting a resin forming into the forming mold to form a push rod integrated with the contact plate.

According to the manufacturing method as referenced above, an independent press process is required for cutting of the material for the contact plate and the punching out of the contact part. Accordingly, the present invention is designed to provide a method for forming a push rod for a switch which does not necessitate the above steps.

SUMMARY OF THE INVENTION

In order to solve the above disadvantages of the conventional art, the first embodiment of the present application is characterized by having a first process of sending a band-like continuing contact plate material into a forming die, a second process for cutting a contact plate material into a predetermined length and punching out the contact part simultaneously with the closing of the forming die, and a third process for forming a push rod integrated with the contact plate by injecting a resin for forming into a forming die.

The second embodiment is characterized in that, in the second process of the first embodiment above, in order to support the central part of the contact plate, a press pin is provided on the forming mold along the center axial line of the push rod, and the end face part which is in direct contact with the contact plate of the press pin is formed in a concave or convex shape.

According to the first embodiment, by means of the forming mold for forming a push rod, the contact plate is cut into a predetermined size from the a hoop material (a band-like continuing material wound in a coil), and the contact part can be formed by closing pressure. Accordingly, contrary to the conventional procedure, it is unnecessary to press form the contact plate by providing a press mold separately from the forming mold, and it becomes possible to curtail the manufacturing steps and the metal molds.

According to the second embodiment, due to the formation of a recess or convex shape at a top end of the press pin for positioning a contact plate at the time a resin is formed a part of the contact plate is deformed in conformity with the profile of the recess or convex shape, thereby serving to strengthen the engagement between the top end part and the contact plate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
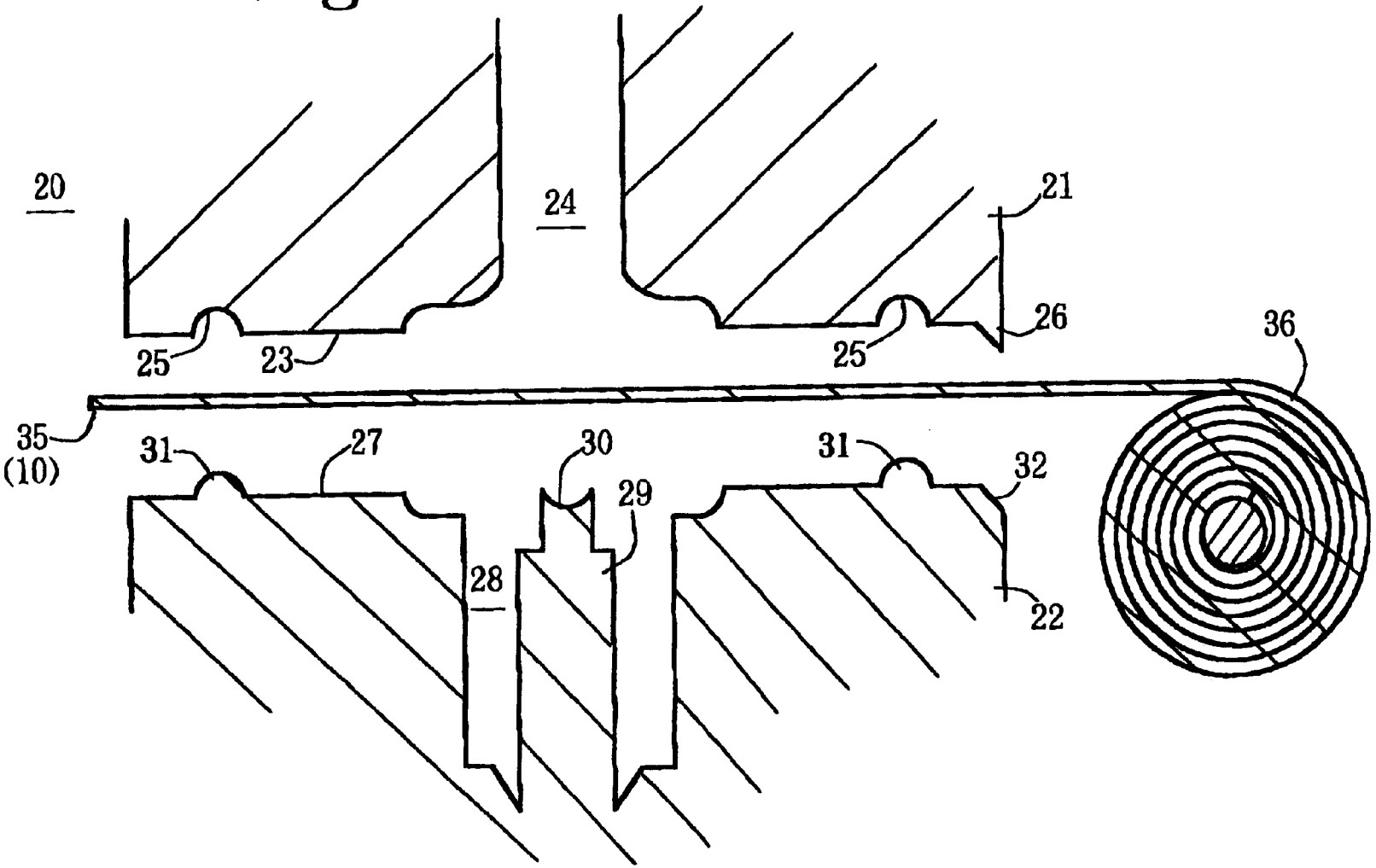
FIG. 1 is a view showing the manufacturing method for the push rod according to the present invention.
Figure 2:
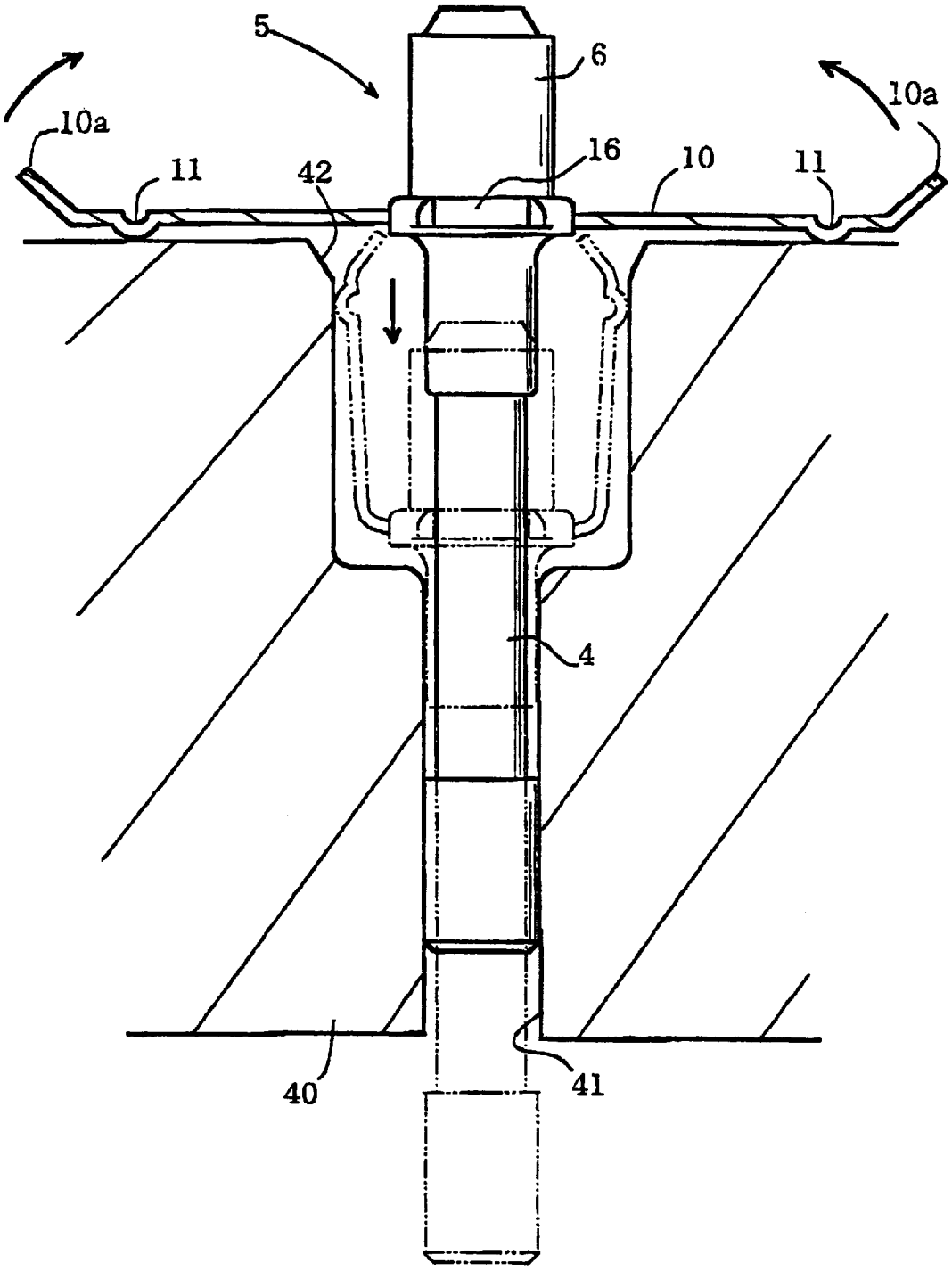
FIG. 2 is a sectional view showing the process for forming of the push rod after molding.
Figure 3:
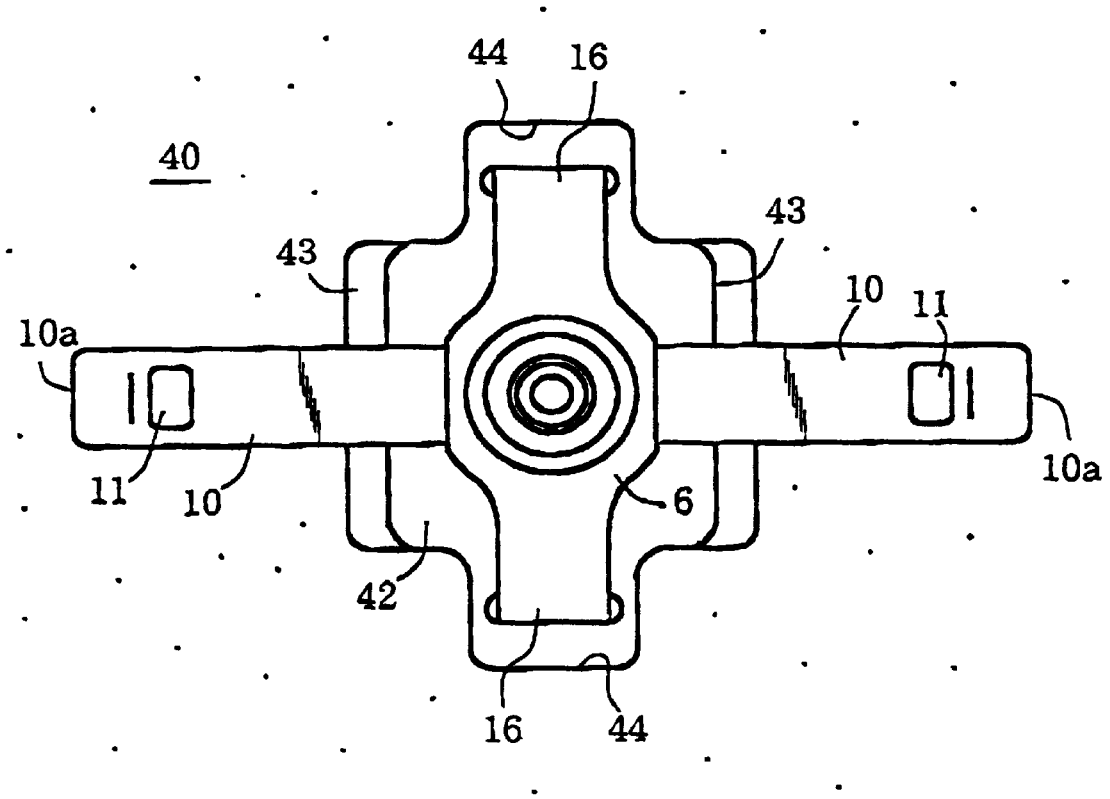
FIG. 3 is a top view thereof.
Figure 4:
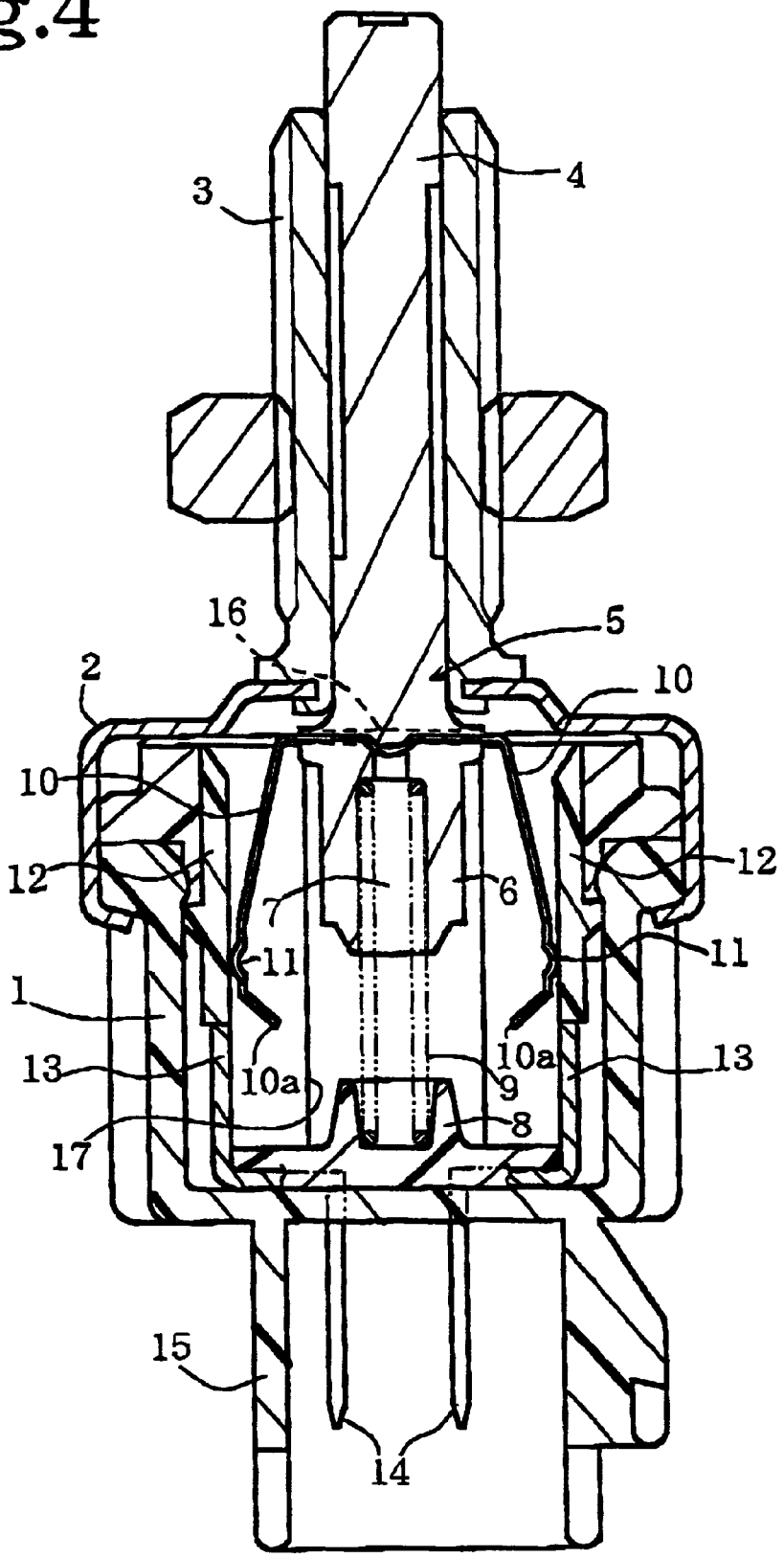
FIG. 4 is a whole sectional view of the push switch.

An embodiment is illustrated based on FIG. 1 to FIG. 4. FIG. 1 is a view to show the manufacturing process, FIG. 2 is a sectional view to show the process for finishing forming the push rod after molding, FIG. 3 is a top face view thereof, and FIG. 4 is a whole sectional view of the push switch.

First, the structure of the push switch will be explained in general. This push switch comprises an approximately cylindrical bottomed resin case 1, a metal lid 2 covering the opening and fixed to the circumference of the resin case 1 by caulking a cylindrical fitting part 3 with a screw formed on the outer circumference extending from the central part of the lid 2, and a push rod 5 having a guide 4 which is inserted in a freely sliding manner in the fitting part 3.

The push rod 5 is as a whole a bar-shaped resin member, and a tip part 6 thereof has larger diameter than the guide part 4 and extends into the resin case 1. On the tip part 6 there is formed a concave part 7 in the direction of a axial center thereof. Between the concave part 7 and a resin retainer 8, provided at the bottom part of the resin case 1, there is provided a return spring 9.

Further, from the tip part 6, a contact plate 10 is spread in right and left directions in approximately a V-shape form. The contact plate 10 is, for example, a band shaped member comprising relatively soft material such as phosphor bronze or brass. The right and left tip parts 10*a* have respective free ends, and are bent inward so as not obstruct assembly and sliding movement of the right and left tip parts 10*a*.

In the vicinity of the right and left tip parts 10*a*, there are formed the contact parts 11 which project outward. When the contact plate 10 shifts downward integrally with the tip parts 6, by pushing the push rod 5 against the return spring 9, contacts 11 are brought into contact with fixed contacts 13 which are provided in a vertical direction downward from the insulated part 12 provided on the upper part of the inner wall surface of the resin case 1. This operation allows the switch to become conductively operational.

The fixed contact parts 13 project outward from the bottom part of the resin case 1 forming coupler terminals 14 and project into the coupler part 15 which is formed integrally with the resin case 1.

From the tip part 6 the stoppers 16 are formed to project right and left in the direction orthogonal with the contact plate 10 (ref FIG. 3). The stoppers 16 are capable of moving in an axial long groove 17 formed in the insulating part 12 according to the advance and recession movements of the tip part 6.

FIG. 1 is a view to show the forming method of the push rod 5. The forming mold 20, which forms a push rod 5, is made by combining an upper mold 21 and a lower mold 22, of which are made of resin molds.

Parting lines 23, 27 for the upper mold 21 and the lower mold 22 are the portions in which the contact plate 10 is to be inserted out of the tip part 6. On the forming mold 20 there is formed a cavity 24 corresponding to a part of the tip part 6 and a guide part 4, and on a part of the upper mold 21 are concave parts 25 for forming contact parts 11; and further an edge part 26 is formed.

On the lower mold 22 there is formed a cavity 28 corresponding to the foremost position of the tip part 6, at the central part thereof a press pin 29 is formed in projection at the same height as that of the parting line 27, and on the end face of the tip part thereof concave part 30 is formed, and further there are formed a convex parts 31 corresponding to the concave parts 25 of the upper mold 21. Also, there is formed an edge part 32 corresponding to the edge part 26.

Between the upper mold 21 and the lower mold 22 there is continuously supplied from a roll 36 a band-like raw material 35 for the contact plate. By closing the upper mold 21 and the lower mold 22 the band-like raw material 35 is is cut as a contact plate 10 of a predetermined size.

The manufacturing process for the push rod 5 comprises a first process in which the band-like raw material 35 is supplied to a predetermined length, a second process for forming a contact plate 10 from the band-like raw material 35, a third process for injecting the forming resin to form into a predetermined shape, and the subsequent finishing process for shaping.

In the second process, the upper mold 21 and the lower mold 22 are closed to cut the band-like raw material 35 with the edge parts 26, 32 of the upper mold 21 and the lower mold 22 to the predetermined size. At the same time, the convex parts 31 for the contact is fitted into the concave parts 25 to form the contact part 11 by punching out a part of the band-like raw material 35. At this time, the tip of the press pin 29 is in direct contact with the central part of the band-like raw material 35 to act as a presser for the band-like raw material 35.

In the third process, a suitable resin for forming is injected in the cavity 24 and the cavity 28 to form the push rod 5 integrated with the contact plate 10. The contact plate 10 projects in right and left directions to form an approximately a cross shape. However, the contact plate 10 is not bent in a V-letter shape by the above process, therefore, a finishing process is required to form the V-letter shape.

As shown in FIG. 2, the jig 40 for the finishing process is provided on its central part with a slot 41 corresponding to the guide part 4 and a diameter-expanded part 42 which is a concave part larger than the tip part 6. FIG. 3 is a top face view of FIG. 2 in the condition prior to pushing the tip part 6 into the diameter-expanded part 42, which is provided with a wall part 43 for forming the contact plate 10, and a guide groove 44 for guiding the stopper 16.

Accordingly, when the guide part 4 is inserted in the slot 41 of the jig 40, and then the whole push rod 5 is further pushed in, the tip part 6 is pushed into the diameter-expanded part 42, and at the same time as shown in the imaginary line, the contact plate 10 is form bent in the diameter-expanded plate 42.

Next, the operation of the present embodiment is explained. In this embodiment, by means of the forming mold 20 for forming a push rod, the contact plate 10 is cut from the band-like raw material 35 and the contact part 11 can be formed by closing pressure.

Accordingly, contrary to the conventional procedure, it is unnecessary to separately form the contact plate; therefore, it becomes possible to curtail the manufacturing steps and the metal molds.

Moreover, due to the formation of a concave part 30 at the tip of the press pin 29 for positioning the contact plate 10 at the time of the resin forming, a part of the contact plate 10 is projected into the concave part 30 and deformed by the molding pressure of resin, thereby serving to strengthen the engagement between the tip part 6 and the contact plate 10.

In addition, because the finishing forming of the contact plate 10 is made by using the jig 40 during the finishing process, it becomes possible to provide automatic assembling and therefore, it is simple to control a contact pressure.

The concave part 30 may be inversely a convex part. Further, the structure of the push switch can be of various known structures.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for forming a push rod for a switch, the method comprising the steps of:

unreeling a band-like raw material to obtain a predetermined length of the band-like raw material;

positioning the band-like raw material between two opposing mold faces;

closing each of the opposing mold faces to make contact with the band-like material, wherein the closing of the opposing mold faces cuts the band-like raw material at the predetermined length and forms a contact part for the push rod thereon;

injecting a resin into molds of the two opposing mold faces to form the push rod integrated with the cut band-like material, forming the band-like material with bent ends on respective ends thereof; and bending the push rod integrated with the cut band-like material in a V-shape form.

2. The method according to claim 1, wherein the step of injecting forms the push rod integrated with the cut band-like material into a cross shape.

3. The method according to claim 1, further comprising the step of molding at least one concave portion along a length portion of the cut band-like material.

4. The method according to claim 3, wherein the step of molding said at least one concave portion forms two concave portions being positioned along the length portion of the cut band-like material.

5. The method according to claim 4, wherein the step of molding the two concave portion forms a convex portion positioned between the two concave portions.

6. The method according to claim 1, wherein the step of bending includes pushing the push rod integrated with the cut band-like material into a diameter-expanded part to form the V-shape form.

7. The method according to claim 1, wherein the step of closing forms a press pin provided along a center axial line of the push rod.

* * * * *